US012708188B2

(12) United States Patent
Akerele et al.

(10) Patent No.: US 12,708,188 B2
(45) Date of Patent: Aug. 18, 2026

(54) DEVICES FOR APPLYING COMPOSITIONS TO EYELASHES

(71) Applicant: L'Oreal, Paris (FR)

(72) Inventors: Dominic Akerele, Brooklyn, NY (US); Fred Orsita, Wayne, NJ (US); Maya Kelley, San Francisco, CA (US)

(73) Assignee: L'Oreal, Paris (FR)

( * ) Notice: Subject to any disclaimer, the term of this patent is extended or adjusted under 35 U.S.C. 154(b) by 27 days.

(21) Appl. No.: 18/945,960

(22) Filed: Nov. 13, 2024

(65) Prior Publication Data

US 2025/0213022 A1 Jul. 3, 2025

Related U.S. Application Data

(60) Provisional application No. 63/615,184, filed on Dec. 27, 2023.

(51) Int. Cl.

| | |
|---|---|
| ***A45D 40/26*** | (2006.01) |
| ***A45D 34/00*** | (2006.01) |
| ***A45D 34/04*** | (2006.01) |

(52) U.S. Cl.

CPC ..... *A45D 40/262* (2013.01); *A45D 2034/005* (2013.01); *A45D 34/04* (2013.01); *A45D 2200/054* (2013.01); *A45D 2200/058* (2013.01); *A45D 2200/157* (2013.01)

(58) Field of Classification Search

CPC ..... A45D 40/262; A45D 2200/054; A45D 2200/157; A45D 44/00; A45D 44/005; A45D 2024/005; A45D 2044/007; A45D 34/04; A45D 2200/155; A45D 2200/058

USPC ..... 401/2, 44–47, 188 R, 270

See application file for complete search history.

(56) References Cited

U.S. PATENT DOCUMENTS 12,156,582 B2 * 12/2024 Rocchisani ..... A45D 44/005

FOREIGN PATENT DOCUMENTS

| | | | |
|---|---|---|---|
| FR | 3 130 119 | A1 | 6/2023 |
| WO | 2010/012807 | A2 | 2/2010 |
| WO | 2017/174584 | A1 | 10/2017 |
| WO | 2019/067336 | A2 | 4/2019 |

OTHER PUBLICATIONS

Preliminary Search Report and Written Opinion mailed Jul. 22, 2024, issued in corresponding French Application No. 2401514, filed Feb. 16, 2024, 8 pages.

* cited by examiner

*Primary Examiner* — David J Walczak

(74) *Attorney, Agent, or Firm* — Christensen O'Connor Johnson Kindness PLLC

(57) ABSTRACT

Devices for applying compositions, such as curable cosmetic eyelash extension compositions, to eyelashes. A device includes elements for mixing, heating, and extruding the composition from the device, as well as elements for sensing the position of the device and coordinating application of the composition to the eyelashes, during a gesture, based on sensed positions and desired lengths of filaments to be added to the eyelashes. The device includes means for priming eyelashes for receipt of the compositions thereto as well as wireless communications features for interaction with computational devices, such as smartphones.

15 Claims, 10 Drawing Sheets

DEVICES FOR APPLYING COMPOSITIONS TO EYELASHES

CROSS-REFERENCE(S) TO RELATED APPLICATION(S)

This U.S. nonprovisional application claims the benefit of, and priority to, U.S. provisional application No. 63/615,184 filed Dec. 27, 2023, and French application no. FR 2401514 filed Feb. 16, 2024; the contents of which are incorporated by reference herein in their entireties for all purposes.

SUMMARY

In an aspect, the disclosure provides a device for application of a composition to a set of eyelashes, the device comprising: a dispensing system, comprising: a motor operably connected to a power source, a mixer operably connected to the motor and configured to mix a plurality of formulas to produce the composition, and a pump operably connected to the motor and configured to pump the composition through an internal volume of the device; and an application system, comprising: a heat element operably connected to the power source and configured to heat the composition within the internal volume, and an extruded outlet fluidly connected to the internal volume for extrusion of the composition therefrom.

In embodiments, the device further comprises: a formula pack comprising the plurality of formulas, wherein the formula pack is reversibly attachable to a body of the device for delivery of the plurality of formulas to the mixer of the device to produce the composition.

In embodiments, the plurality of formulas comprises: a resin formula and a curing formula.

In embodiments, the plurality of formulas comprises: a customizable formula.

In embodiments, the device further comprises: a thermal sensor configured to measure temperature of the composition within the internal volume of the device for a measured temperature, and circuitry operably connected to the thermal sensor and configured to control a function of the heat element for adjustment of temperature of the composition based on the measured temperature and a temperature threshold.

In embodiments, the temperature threshold is particular to the composition based on the plurality of formulas.

In embodiments, the device further comprises: an accelerometer, a gyroscope, or both, operably connected to circuitry of the device for detection of a movement of the device, an orientation of the device, or both; wherein the movement, the orientation, or both is for determination of a status of a gesture to apply the composition to the set of eyelashes by the circuitry.

In embodiments, the status of the gesture is selected among a set of movement values, a set of orientation values, or both, positioned between a start point of the gesture and a finish point of the gesture, that define a working space within which extrusion of the composition from the device applies the composition to the set of eyelashes.

In embodiments, the device further comprises: a contact sensor, a conductance sensor, or both, operably connected to circuitry of the device for detection of a position of the device relative to a facial feature; wherein the position is for determination, by the circuitry, of whether the device is positioned at a start point of a gesture to apply the composition to the set of eyelashes.

In embodiments, a set of position values, positioned between the start point of the gesture and a finish point of the gesture, define a working space within which extrusion of the composition from the device applies the composition to the set of eyelashes.

In embodiments, the device further comprises: an optical system operably connected to circuitry of the device for detection of a position of the device relative to a facial feature; wherein the position is for determination, by the circuitry, of whether the device is positioned at a start point of a gesture to apply the composition to the set of eyelashes.

In embodiments, the optical system comprises: a light element configured to irradiate the facial feature and an infrared (IR) camera configured to capture an IR image of the facial feature and transmit data of the IR image to the circuitry of the device for determination, by the circuitry, of whether the device is positioned at the start point of the gesture to apply the composition to the set of eyelashes.

In embodiments, the device further comprises: a wireless transceiver, operably connected to circuitry of the device, configured for wireless communication with a computational device comprising circuitry for user interaction with the device.

In embodiments, the device further comprises: a plurality of bristles, arranged in a brush configuration or a clamp configuration, configured to contact the set of eyelashes for application of the composition thereto.

In embodiments, the device further comprises: a plurality of conductive bristles operably connected to the power source and configured to hold an electric charge from the power source and contact the set of eyelashes to transfer at least part of the electric charge to the set of eyelashes, such that the set of eyelashes is primed to facilitate adherence of the composition thereto.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Figure 1:
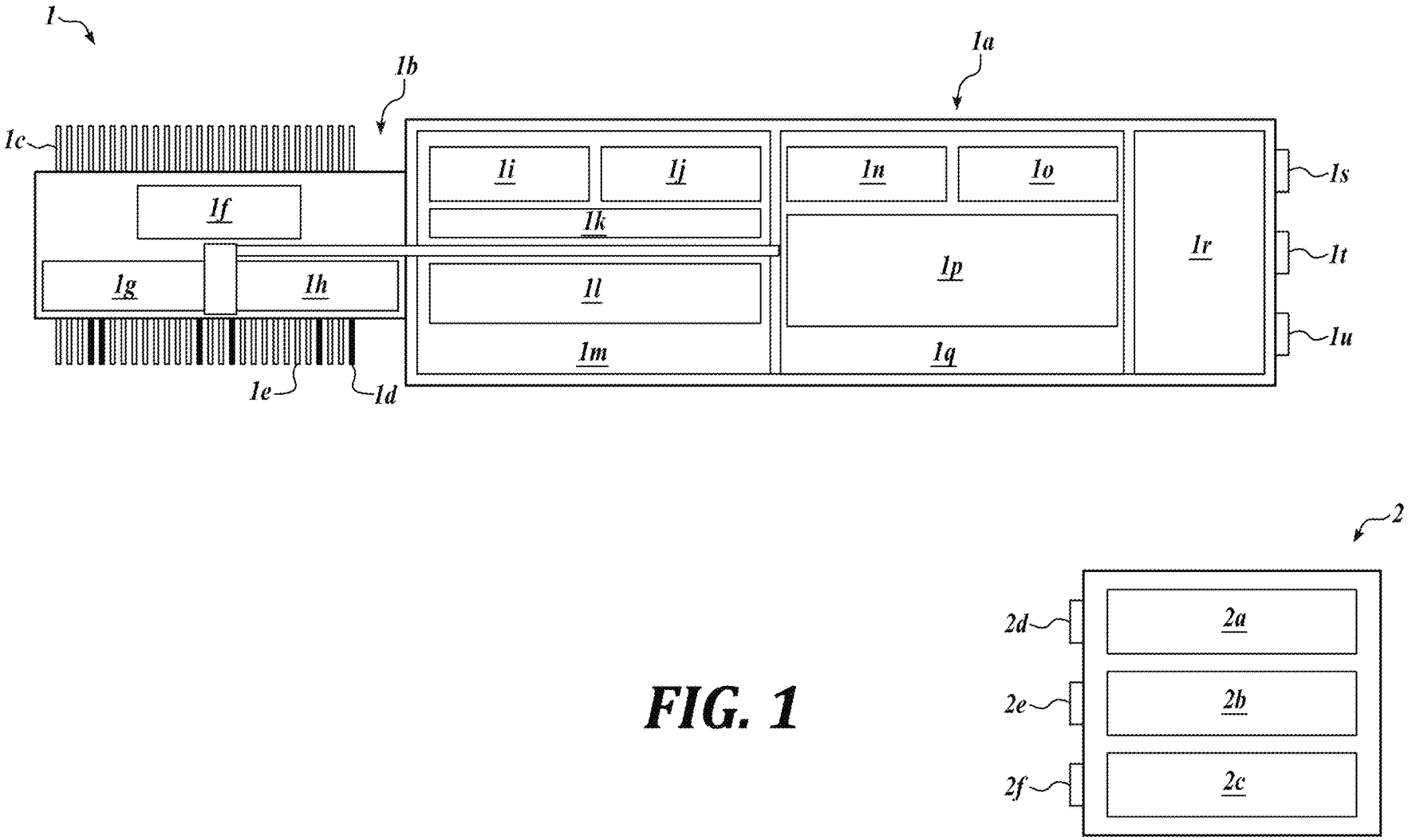
FIG. 1 shows a diagram of an example device for application of a composition to a set of eyelashes, according to aspects of the disclosure.

The foregoing aspects and many of the attendant advantages of this disclosure will become more readily appreciated as the same become better understood by reference to the following detailed description, when taken in conjunction with the accompanying drawings.

DETAILED DESCRIPTION

Eyelash modifications to alter the eyelashes include: false eyelashes, in which a fiber is affixed to a subject's natural eyelashes; mascara to darken, thicken, lengthen, and define the eyelashes; and eyelash extension compositions that can be applied to the eyelashes with brush and rod applicators to extend the structure of the eyelash beyond their natural ends. Existing approaches for the application of compositions to the eyelashes are unsatisfactory for a variety of reasons, such as off-target application to the skin or another surface, detachment of the composition from the eyelashes, and uneven distribution of the composition along the length of the eyelash. Accordingly, there is a need for overall improved approaches for application of compositions to the eyelashes, including approaches that ensure accurate and precise application, and that configure the eyelashes for superior adherence with the composition once applied. The present disclosure addresses these and other long-felt and unmet needs in the art.

Accordingly, in an aspect, the disclosure provides a device for application of a composition to a set of eyelashes that includes a dispensing system comprising elements to mix and pump the composition within the device during use, and an application system comprising elements to heat and extrude the composition from the device, at the time of application, during use. The device can comprise intelligent control elements, such as monitoring and control circuitry, for monitoring the application process and controlling the dispensing system, the application system, and other elements, for ensuring that the composition is applied within a working space that includes a length of an eyelash and, optionally, an extension length that extends beyond the natural end of the eyelash. The working space defines a distance, space, or volume within which the composition is to be applied to the eyelash during a use of the device.

Example devices of the disclosure, and example elements thereof, are shown at FIGS. 1, 2, 3, 4, and 5. A device can be configured to include a handle affixed to a head, according to at least some form factors. While certain elements are diagrammed as being within the handle or the head, it should be understood that these and any other elements included in an implementation of a device can be moved or rearranged within the device, or within one or more additional spaces or structures that are operable with or additionally constitute the device, without departing from the scope and spirit of the disclosure. Importantly, placement of diagrammatic elements at positions within the handle or the head as shown, as the case may be, is for illustrative purposes only, and does not exclude alternate configurations according to embodiments that are expressly contemplated and are included within the overall scope of the disclosure. In addition, while explicit structures for certain elements of devices may not be expressly shown or described herein, it should be understood that these or equivalent structures can be obtained from the art and are available to the person having ordinary skill in the art seeking to practice the aspects of the disclosure.

In addition, although connections between elements of a device may not be explicitly shown in the figures, it should be understood that the shown elements, and any other elements of a device implementation, can be interconnected in any number, order, or combination for their function or function of the device as a whole. Connections can include, but are not limited to, one or more fluid or fluidic connections, one or more operable connections, one or more electrical connections, one or more mechanical or physical connections, one or more communication connections, one or more wired connections, one or more wireless connections, one or more logical connections, one or more wireless electromagnetic connections for wireless charging of a power source, one or more circuitry connections, and the like. For example, one or more connections can be implemented between any two or more elements as listed at Table 1, and as shown in the corresponding figures, for operation of a device (or for operation of elements or systems of the device). These and any other connections implemented in an embodiment can be used for coordinating operation of the elements of the device and facilitating the overall operation of the device during use. This coordination can occur with use of one or more sensors, computational devices, software applications, control circuitry, and the like, as further described herein and as encompassed by equivalents thereof.

Figure 2:
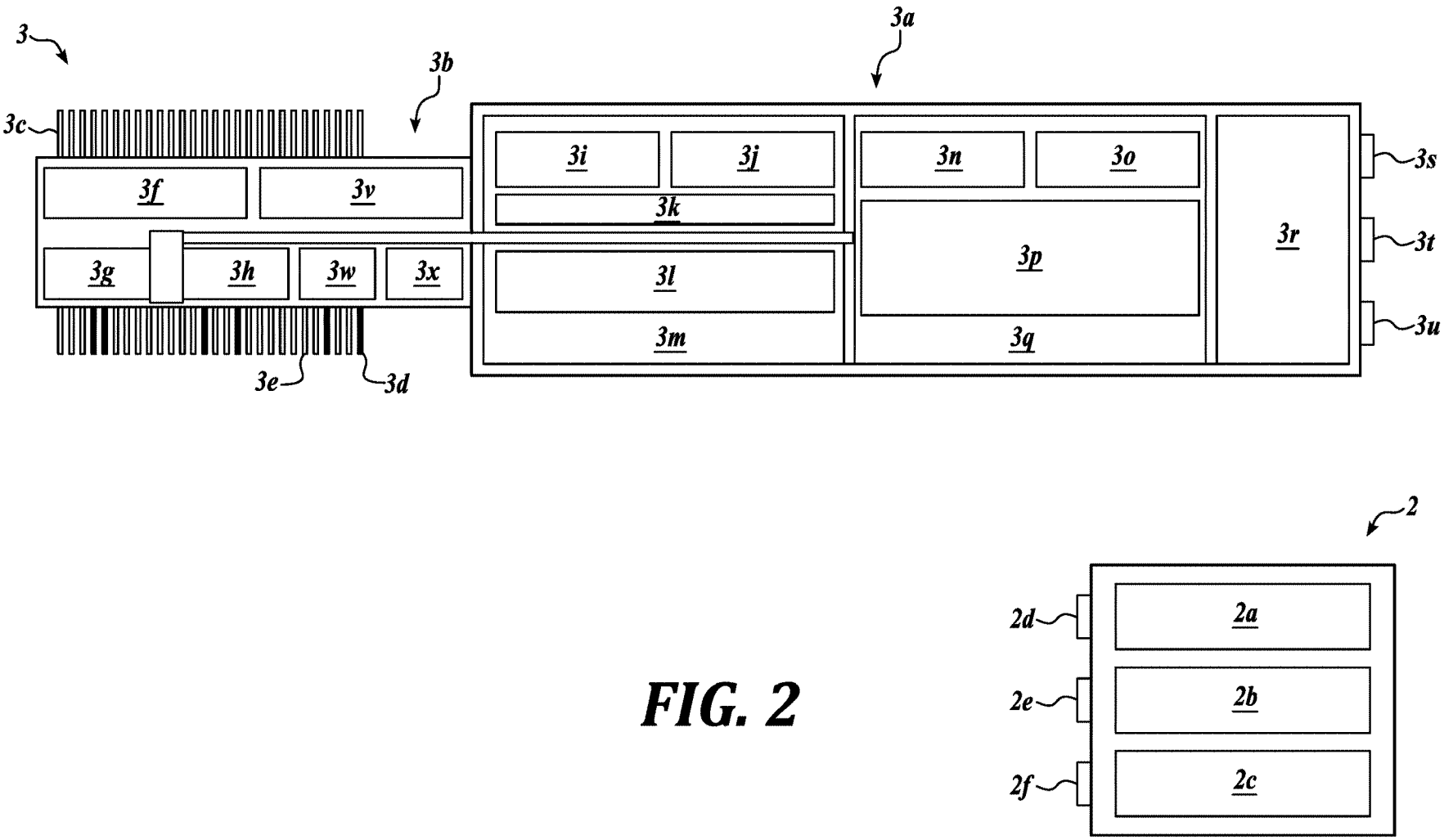
FIG. 2 shows a diagram of an example device for application of a composition to a set of eyelashes with an optical system, according to aspects of the disclosure.

As shown at FIGS. 1 and 2, a device (1, 3) includes a handle (1*a*, 3*a*) and a head (1*b*, 3*b*). The device (1, 3) includes a dispensing system, comprising: a motor (1*o*, 3*o*) operably connected to a power source (1*r*, 3*r*), a mixer (1*n*, 3*n*) operably connected to the motor (1*o*, 3*o*) and configured to mix a plurality of formulas (2*a*, 2*b*, 2*c*) to produce the composition, and a pump (1*p*, 3*p*) operably connected to the motor (1*o*, 3*o*) and configured to pump the composition through an internal volume of the device (1, 3). The device (1, 3) also includes an application system, comprising: a heat element (1*f*, 3*f*) operably connected to the power source (1*r*, 3*r*) and configured to heat the composition within the internal volume, and an extruded outlet (1*f*, 3*f*) fluidly connected to the internal volume for extrusion of the composition therefrom.

The formulas (2*a*, 2*b*, 2*c*) can be mixed prior to a use, during the use, or after the use (e.g., for a future use), in embodiments. In particular embodiments, the formulas (2*a*, 2*b*, 2*c*) can be combined to form a curable composition, and mixed shortly before use, such that the composition does not cure within the device. In embodiments, a portion of the internal volume is for holding a curable composition after being mixed but prior to being extruded, and can be limited in size such that excess or unused curable composition does not cure within the device. In various embodiments, a composition formed from mixing the formulas (2*a*, 2*b*, 2*c*) can be heated shortly before being extruded from the device, such that the extruded composition is hot or warm and is flowable and able to be extruded and applied to the eyelashes. In embodiments, the application of heat to a composition can prevent or delay curing of the composition, such that the composition does not cure within the device. In at least some embodiments, the device can be cleansed with water or another solvent to cleanse unused formula or composition or other debris from the device after a use.

The composition can be produced by mixture of a plurality of formulas (2*a*, 2*b*, 2*c*). While any suitable composition can be applied to eyelashes with a device, in at least some embodiments, a curable composition can be applied. A curable composition can be produced by mixture of a cosmetic resin formula and a curing agent formula, for example, that can optionally be further mixed with a customizable formula. The cosmetic resin formula can create structure for the filament produced by the composition when applied to the eyelashes; the curing agent formula can comprise a catalyst that activates a crosslinking or other reaction for curing of the cosmetic resin formula, and the customizable formula can comprise a mixture of cosmetic polymers, film formers, and the like, that enable any of a variety of cosmetic benefits imparted to the eyelashes with the composition, such as moisturizing, curling, lengthening, and the like.

The formulas (2*a*, 2*b*, 2*c*) can be comprised within a formula pack 2, as shown by way of example at FIGS. 1 and 2, as a consumable product for use with the device (1, 3). The formula pack 2 can be reversibly attached to the device (1, 3) and can form connections between formula adapters (1*s*, 1*t*, 1*u*) of the device (1, 3) and formula pack adapters (2*d*, 2*e*, 2*f*) of the formula pack 2. These connections can comprise fluid or fluidic connections that fluidly connect the (separated) formulas (2*a*, 2*b*, 2*c*) with corresponding formula adapters of the device for being combined and mixed within the device (1, 3). When one or more formulas of the formula pack 2 are consumed, a new or refilled formula pack 2 can be connected to the device (1, 3) for further use of the device (1, 3).

In various embodiments, the formula pack 2 can be configured for a particular cosmetic benefit or application. For example, a customizable formula (e.g., 2*a*, 2*b*, or 2*c*) of the formula pack 2 can be formulated for a particular texture, volume, stiffness, density, color, or other property of the eyelash filament after being formed by application of the composition to the eyelashes. Among at least some embodiments of the formula pack 2, the curing agent formula (e.g., 2*a*, 2*b*, or 2*c*) and the cosmetic resin formula (e.g., 2*a*, 2*b*, or 2*c*) can be held as constant or substantially constant, and the customizable formula (e.g., 2*a*, 2*b*, or 2*c*) varied for different uses or benefits provided by use of different formula packs 2. For example, stiffness or structural integrity of the formed filament can be increased or decreased for production of longer or shorter eyelash filaments by use of different formula packs 2, respectively, according to various embodiments.

Referring again to FIGS. 1 and 2, in embodiments, the device (1, 3) comprises a thermal sensor (1*k*, 3*k*), such as a thermometer, configured to measure temperature of the composition within the internal volume of the device (1, 3) for a measured temperature, and circuitry operably connected to the thermal sensor (1*k*, 3*k*) and operably connect to and configured to control a function of the heat element (1*f*, 3*f*) for adjustment of temperature of the composition based on the measured temperature and a temperature threshold. The circuitry connected to the thermal sensor can convey signals from the thermal sensor (1*k*, 3*k*) to logic circuitry of the device (or of a computational device) for computational determination of whether the measured temperature is within or outside a temperature threshold or range. Based on the comparison, the logic circuitry can transmit signals or electric current to or through the heat element (1*f*, 3*f*), from the power source (1*r*, 3*r*), or can refrain from doing so, to increase or decrease heating of the composition by the heat element (1*f*, 3*f*) and control the temperature of the composition. The temperature of the composition maintained by these elements can be particular to a curing process of the formulas or otherwise particular to the composition based on the plurality of formulas.

In embodiments, the device (1, 3) includes an accelerometer (1*i* 3*i*), a gyroscope (1*j*, 3*j*), or both, operably connected to circuitry of the device (1, 3) for detection of a movement of the device (1, 3), an orientation of the device (1, 3), or both. In embodiments, the movement, the orientation, or both, detected by either or both of these or one or more other sensors of the device (1, 3), can be used for determination, by control circuitry of the device (1, 3), of a status of a gesture being used to apply the composition to the set of eyelashes by the device (1, 3). In embodiments, the status of the gesture correlates, at least partially with or within a tolerable range of, a movement value, an orientation value, or both, among a set of movement values, a set of orientation values, or both, that collectively constitute the gesture. A particular movement value of the set, orientation value of the set, or both, is positioned within a working space defined by a start point of the gesture and a finish point of the gesture. The working space defines the space, from the base of the eyelashes, for example, within which extrusion of the composition from the device is to apply the composition to the set of eyelashes. If, during the gesture, a user performing the gesture deviates substantially from the gesture defined by the set of movement values, set of orientation values, or both, the device (1, 3) can perform an alert action or a corrective action. The action can comprise emission of an alert to the user to pause, stop, continue, or adjust the performance of the gesture; pausing or stopping a function of the device (1, 3) such as mixing, pumping, heating, extruding; or an adjustment of the function of the device (1, 3) so as to accommodate the user's deviation from an optimal application of the composition and maintain the application of the composition within an acceptable range of accuracy. The alert can be an audio alert, a haptic or tactile alert, a visual alert, or any combination thereof.

Referring again to FIGS. 1 and 2, in embodiments, the device (1, 3) further comprises: a contact sensor (1*g*, 3*g*), a conductance sensor (1*h*, 3*h*), or both, operably connected to circuitry of the device (1, 3) and configured for detection of a position of the device (1, 3) relative to a facial feature of a subject whose eyelashes are to receive the composition thereon. The position of the device (1, 3) relative to the facial feature is for determination, by the circuitry of the device (or a computational device) of whether the device (1, 3) is positioned at a start point of a gesture such that the device (1, 3) is able to apply the composition to the set of eyelashes of the subject. For example, the contact sensor (1*g*, 3*g*), the conductance sensor (1*h*, 3*h*), or both, can be configured for detection of contact of one or more contact sensor pins (1*d*, 3*d*) with the eyelid or eyelashes of the subject, and a signal resulting from this contact can be transmitted from circuitry of the contact sensor (1*g*, 3*g*) to logic circuitry of the device (or a computational device) for computational confirmation of the positioning of the device, for example, as can be used as a precondition for mixing, heating, or extrusion of the composition from the device (1, 3). A sensor can be configured for transmission of a small electrical current between two or more contact sensor pins (1*d*, 3*d*) upon contact of the pins (1*d*, 3*d*) with a substrate; in at least some embodiments, electrical current resulting from contact of the pins with the substrate can be measured, by circuitry of the device, and compared with identified ranges of the current for determination of the electrical resistance of the substrate and confirmation of the type of substrate contacted (e.g., hair or fiber, skin, etc.). If, based on the sensor data and result, the substrate contacted by the contact sensor pins (1*d*, 3*d*) is the intended substrate (e.g., eyelashes), the device can be configured to be operable for use. In this manner, the device (1, 3) can be configured so as to avoid deposition of the composition onto an off-target surface, such as skin or eyes or an inert object or surface.

In at least some embodiments, and as shown by way of example at FIG. 2, a device 3 further comprises an optical system 3*v* operably connected to circuitry of the device 3 for detection of a position of the device 3 relative to a facial feature of the subject. The position of the device 3 relative to the facial feature is for determination, by the circuitry of the device (or a computational device), of whether the device 3 is positioned at a start point of a gesture to apply the composition to the set of eyelashes. In embodiments, the optical system 3*v* comprises: a light element 3*x* configured to irradiate the facial feature and an infrared (IR) camera 3*w* configured to capture an IR image of the facial feature and transmit data of the IR image to the circuitry of the device (or a computational device) for determination, by the circuitry, of whether the device 3 is positioned at the start point of the gesture to apply the composition to the set of eyelashes. In embodiments, the light element 3*x* emits at least red or IR light, and the IR camera 3*w* images light that reflects back from the surface of the subject's skin, eyelashes, or eyes. In embodiments, the optical system 3*v* can be calibrated for use with a particular subject by entering a calibration mode of the device 3, positioning the device 3 at the start point of the gesture, and registering imagery of the subject's skin, eyelashes, or eyes at the start point of the gesture with a memory storage of the device (or a computational device). In embodiments, the optical system 3*v* can be calibrated or otherwise configured for use with any of a variety of subjects based on individual, group, population calibration or use data. In embodiments, once calibrated, the optical system can image the subject's skin, eyelashes, or eyes and compare the captured images with the registered image, with image analysis, to determine if the device 3 is adequately positioned for use. For example, the optical system 3*v* can use a facial landmark detection machine learning (ML) model to detect landmarks in imagery captured by the device 3, and can compare locations of the landmarks in the imagery with the locations of landmarks in the registered image. If the locations of the landmarks in the image are the same (or within a threshold tolerance of) the locations of the landmarks in the registered image, the device 3 can determine that the device 3 is at the start position of the gesture. If, based on the optical system data and result, the device 3 is positioned at the start position of the gesture, the device 3 can be configured to be operable for use. In this manner, the device 3 can be configured so as to avoid deposition of the composition onto an off-target surface, such as skin or eyes or an inert object or surface.

Referring again to FIGS. 1 and 2, a device (1, 3) can comprise a plurality of conductive bristles (1*c*, 3*c*) operably connected to the power source (1*r*, 3*r*) and configured to hold an electric charge from the power source (1*r*, 3*r*) and contact the set of eyelashes to transfer at least part of the electric charge to the set of eyelashes. One or more of the eyelashes can thereby have an electrical or ionic charge, such that the set of eyelashes is better able to bond with the composition when applied thereto. In these and other embodiments, the composition can comprise an ionic compound, or plurality of compounds, that includes a charge or net charge, respectively, that is opposite to or complementary with an ionic charge of the primed eyelash fiber. In this manner, the ionic compound or plurality of compounds can ionically bond to the primed eyelash fiber, optionally in combination with one or more covalent bonds, to secure the eyelash filament to the eyelash.

Figure 3:
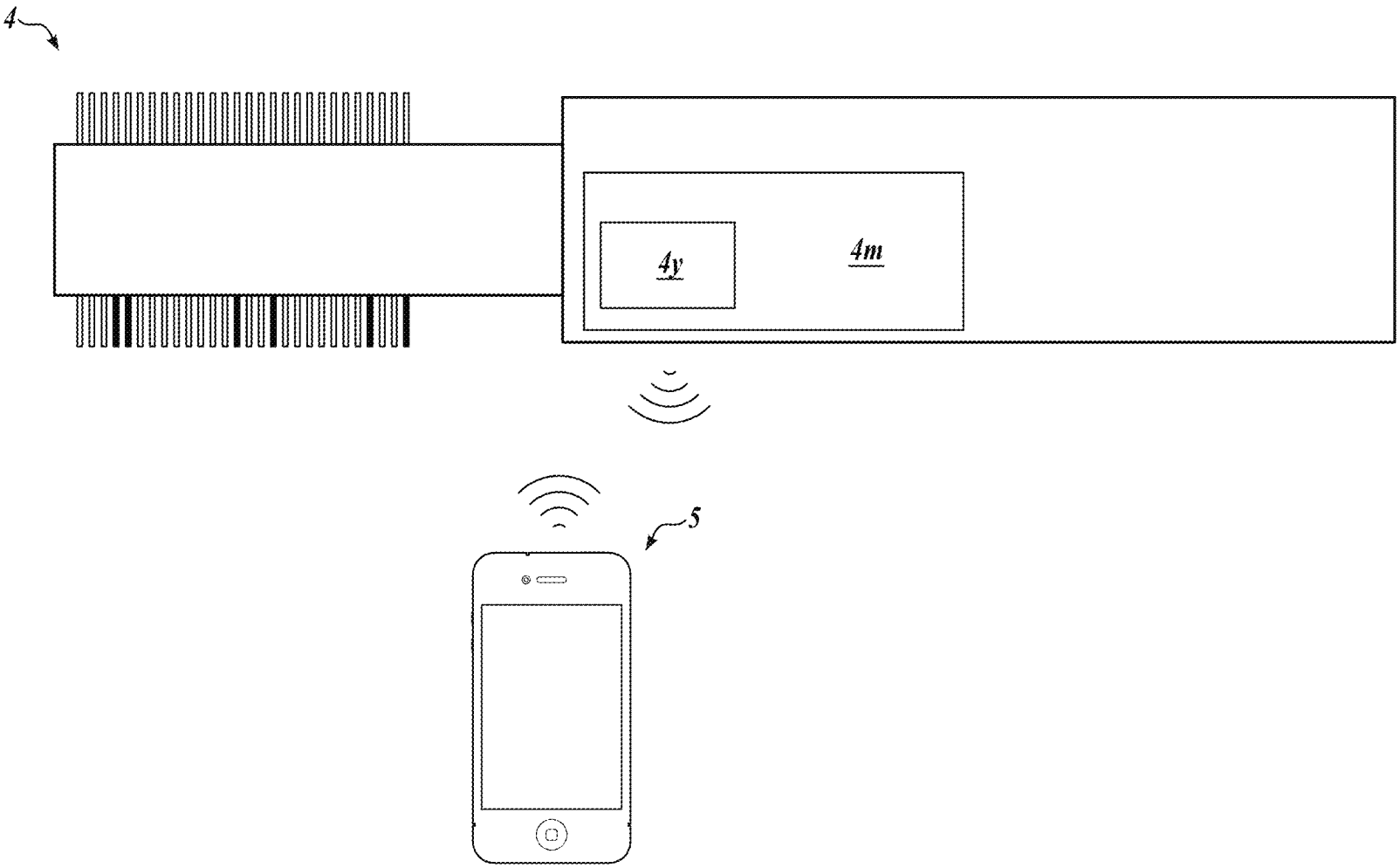
FIG. 3 shows a diagram of an example device for application of a composition to a set of eyelashes with a wireless transceiver, according to aspects of the disclosure.

As shown at FIG. 3, a PCB 4*m* of a device 4 can include, among other things, a wireless transceiver 4*y*. In embodiments, the wireless transceiver 4*y* is operably connected to circuitry of the device 4, and configured for wireless communication with a computational device 5 comprising circuitry for one or more user interactions with the device 4 by way of the computational device 5. The computational device 5 can be any electronic logic device, but in embodiments, can be a mobile phone, tablet, personal computer, smartphone, and the like. While not shown in FIGS. 1 and 2, the wireless transceiver 4*y* can be implemented in the example embodiments of those and other figures of the disclosure, as well as equivalents thereof, without departing from the scope and spirit of the disclosure.

Figure 4:
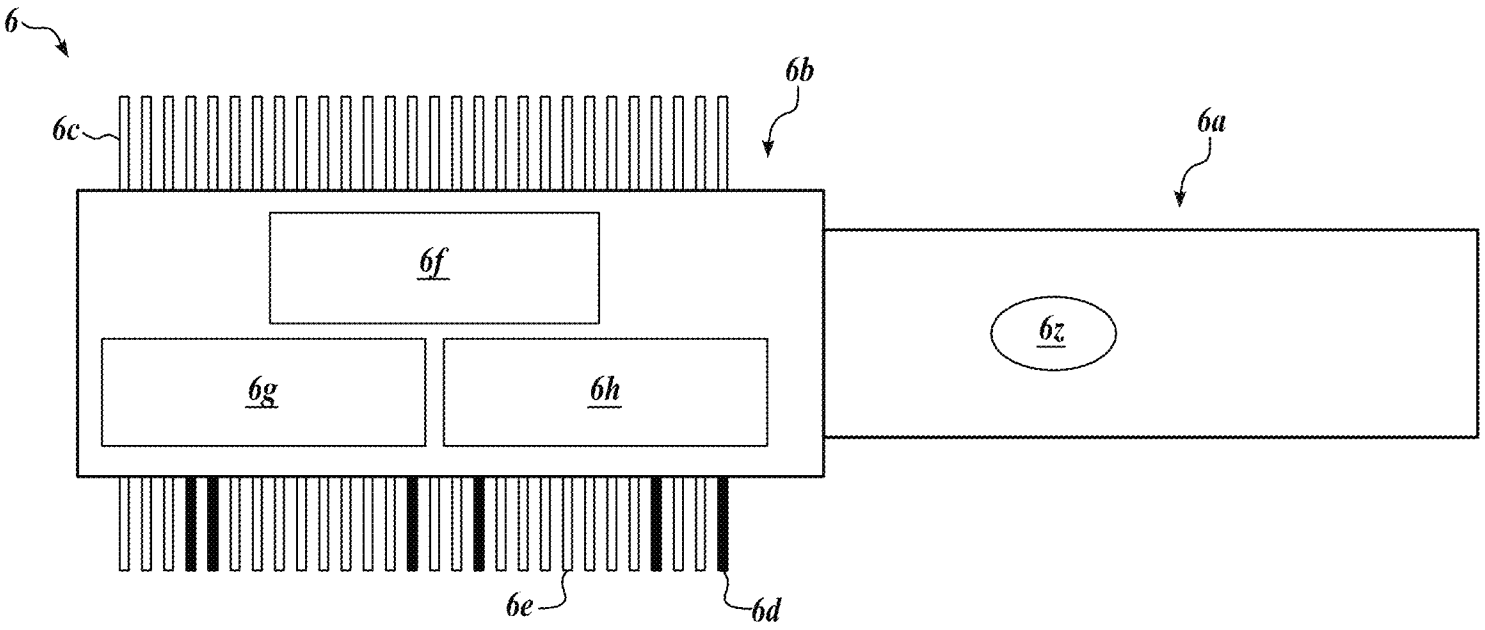
FIG. 4 shows a diagram of an example device for application of a composition to a set of eyelashes with a contact sensor and an on/off control, according to aspects of the disclosure.

FIG. 4 shows an example form factor that can be used for implementation of a device of the disclosure. A device 6 can be shaped as a brush or rod form factor, and can include a handle 6*a* with an on/off control 6*z* thereon, as well as a head 6*b*. The head 6*b* can include a plurality of conductive bristles 6*c* for priming the eyelashes for receipt of the composition thereon, one or more contact sensor pins 6*d* configured for detection of contact with a surface, a plurality of bristles 6*e*, arranged in a brush configuration, for combing the eyelashes and facilitating application of the composition during use, and other elements of the device including a heat element and extruded outlet 6*f*, contact sensor with circuitry 6*g*, and conductance sensor with circuitry 6*h*. During use, a user grasps the handle 6*a*, positions the head 6*b* such that the conductive bristles 6*c* or the bristles 6*e* contact the eyelashes, and activates the device 6 by operation of the on/off control 6*z*. The on/off control 6*z* can include a button, a switch, or the like, for electronic activation of one or more features of the device 6. Once activated, the device 6 can perform one or more checks for determining relative positioning of the device 6, begin mixing, pumping, and heating the composition, and extruding the composition from the extruded outlet of the device 6 to deposit the composition onto the eyelashes.

Figure 5:
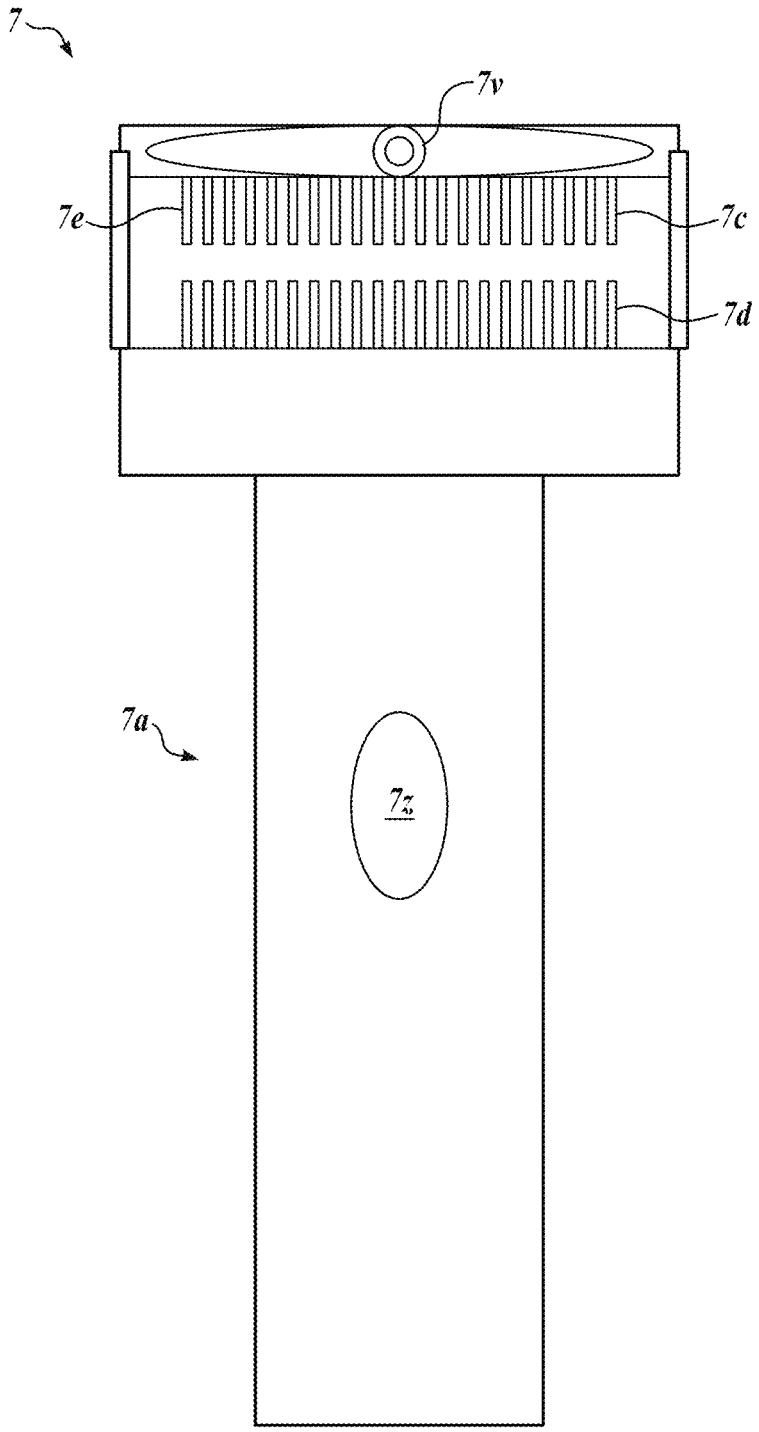
FIG. 5 shows a diagram of an example device for application of a composition to a set of eyelashes in an eyelash curler form factor with an optical system, according to aspects of the disclosure.

FIG. 5 shows another example form factor for a device of the disclosure. A device 7 can be configured into a form that at least partially resembles an eyelash curler. The device 7 can include a handle 7*a* affixed to a head, and the head can comprise conductive bristles 7*c*, a contact sensor pin 7*d*, and bristles 7*e* arranged in a clamp configuration. An optical system 7*v* can be included and positioned toward an upper portion of the device 7. During use, a user grasps the handle 7*a*, positions the head such that the conductive bristles 7*c* or the bristles 7*e* contact the eyelashes, and activates the device 7 by operation of the on/off control 7*z*. The on/off control 7*z* can include a button, a switch, or the like, for electronic activation of one or more features of the device 7. Once activated, the device 7 can perform one or more checks for determining relative positioning of the device 7, begin mixing, pumping, and heating the composition, and extruding the composition from the extruded outlet of the device 7 to deposit the composition onto the eyelashes.

In an aspect, the disclosure provides a kit comprising a device of the disclosure, a formula or a formula pack of the disclosure, an instructional material for instructing a method of use of the device to a user, or any combination thereof.

In an aspect, the disclosure provides a method for applying a composition to a set of eyelashes of a subject, the method comprising: positioning a device for application of the composition to the set of eyelashes at a start point of a gesture for application of the composition to the set of eyelashes; activating the device for an activation and performing the gesture to apply the composition to the set of eyelashes; and positioning the device at a finish point of the gesture, at which point the device ceases application of the composition to the set of eyelashes. In various embodiments, the method for applying the composition to the set of eyelashes of the subject can be carried out at least in part by provision of an instructional material for instructing a method of use of the device to a user. In embodiments, the instructional material is provided to the user as a part of a kit, for example, as a result of purchasing the kit and, optionally, mail order or other physical delivery of the kit to the user or another individual. In embodiments, the kit comprises the device for application of the composition to the set of eyelashes, the formula or formula pack, an element for repair or modification of the device, the instructional material, or any combination thereof.

Figure 8:
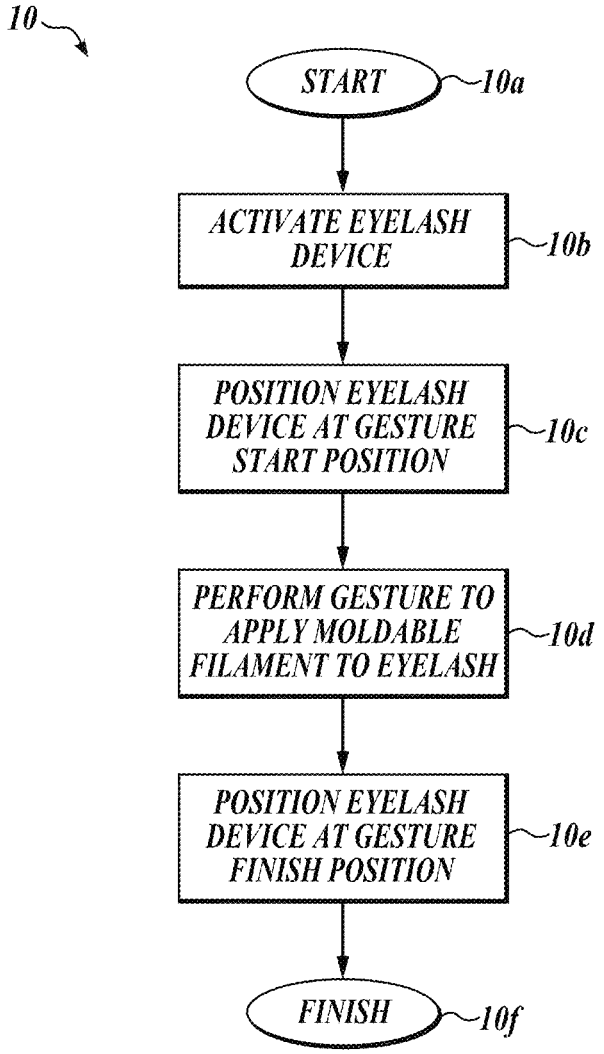
FIG. 8 shows a flowchart of an example method of use of a device for applying moldable filament to eyelashes, according to aspects of the disclosure.

Accordingly, as shown at FIG. 8, an example method of use 10 of a device for applying moldable filament to eyelashes can include, at step 10*a*, start; at step 10*b*, activate eyelash device; at step 10*c*, position eyelash device at gesture start position; at step 10*d*, perform gesture to apply moldable filament to eyelash; at step 10*e*, position eyelash device at gesture finish position; and at step 10*f*, finish.

Figure 9:
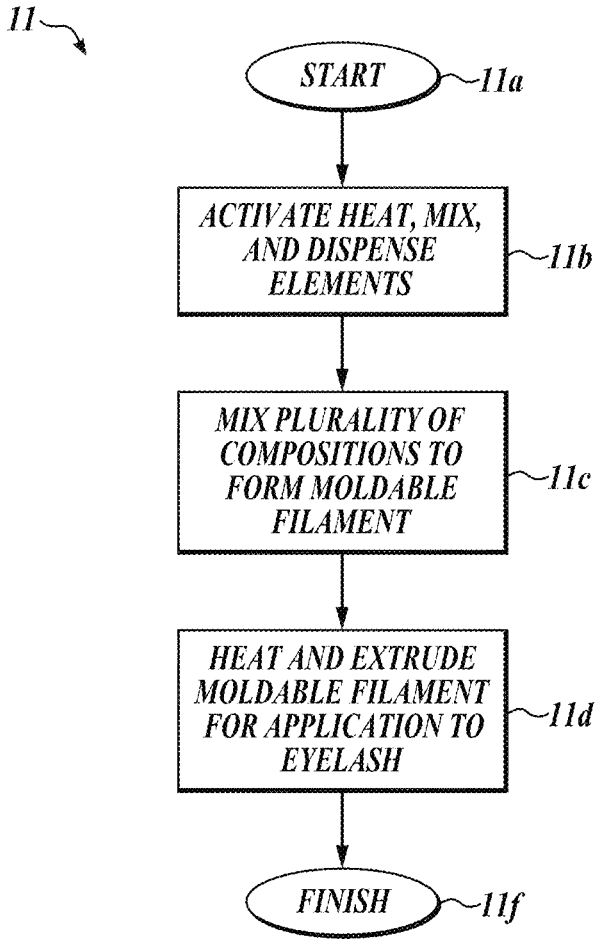
FIG. 9 shows a flowchart of an example method of operation of a device for mixing, heating, and extruding moldable filament to eyelashes, according to aspects of the disclosure.

In embodiments, the device can perform various operations in support of the application of the moldable filament to the eyelashes, as shown by way of an example at FIG. 9. An example method of operation of a device for mixing, heating, and extruding moldable filament to eyelashes 11 includes, at step 11*a*, start; at step 11*b*, activate heat, mix, and dispense elements; at step 11*c*, mix plurality of compositions to form moldable filament; at step 11*d*, heat and extrude moldable filament for application to eyelash; and at step 11*f*, finish.

Figure 6:
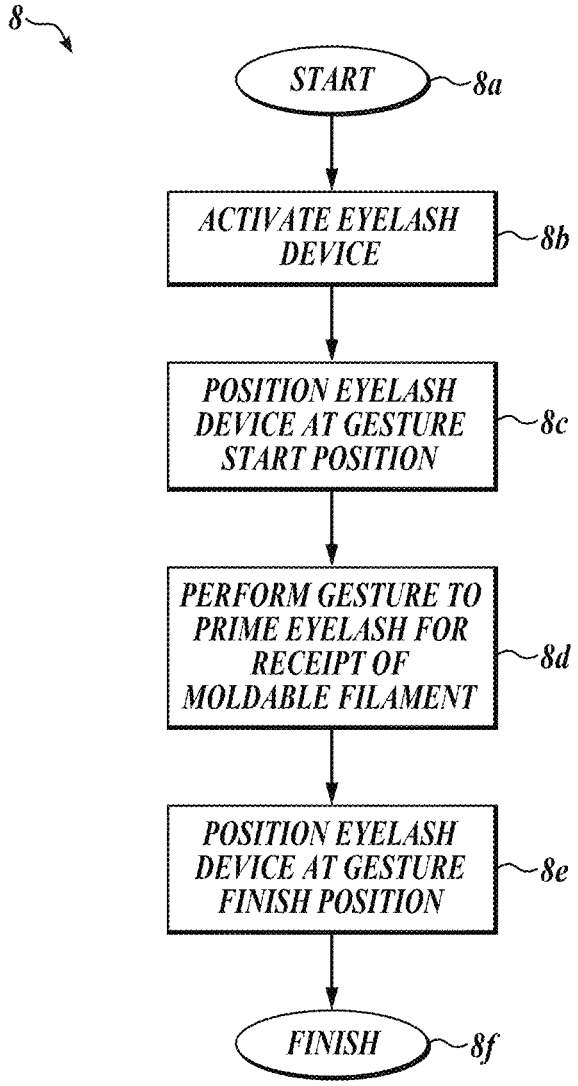
FIG. 6 shows a flowchart of an example method of use of device for priming eyelashes, according to aspects of the disclosure.

In various aspects, the disclosure provides a method for priming eyelashes for receipt of a composition thereon, using a device of the disclosure, as shown by way of an example at FIG. 6. In embodiments, the eyelashes can be primed prior to application of the composition thereto for enhance adherence of the filament to the eyelashes, as further described herein. Such a method 8 can include, at step 8*a*, start; at step 8*b*, activate eyelash device; at step 8*c*, position eyelash device at gesture start position; at step 8*d*, perform gesture to prime eyelash for receipt of moldable filament; at step 8*e*, position eyelash device at gesture finish position; and at step 8*f*, finish. In embodiments, the device can have two or more activation modes, for example, a priming mode (for priming eyelashes for receipt of a composition thereon) and an application mode (for applying a composition to a set of eyelashes of a subject).

Figure 7:
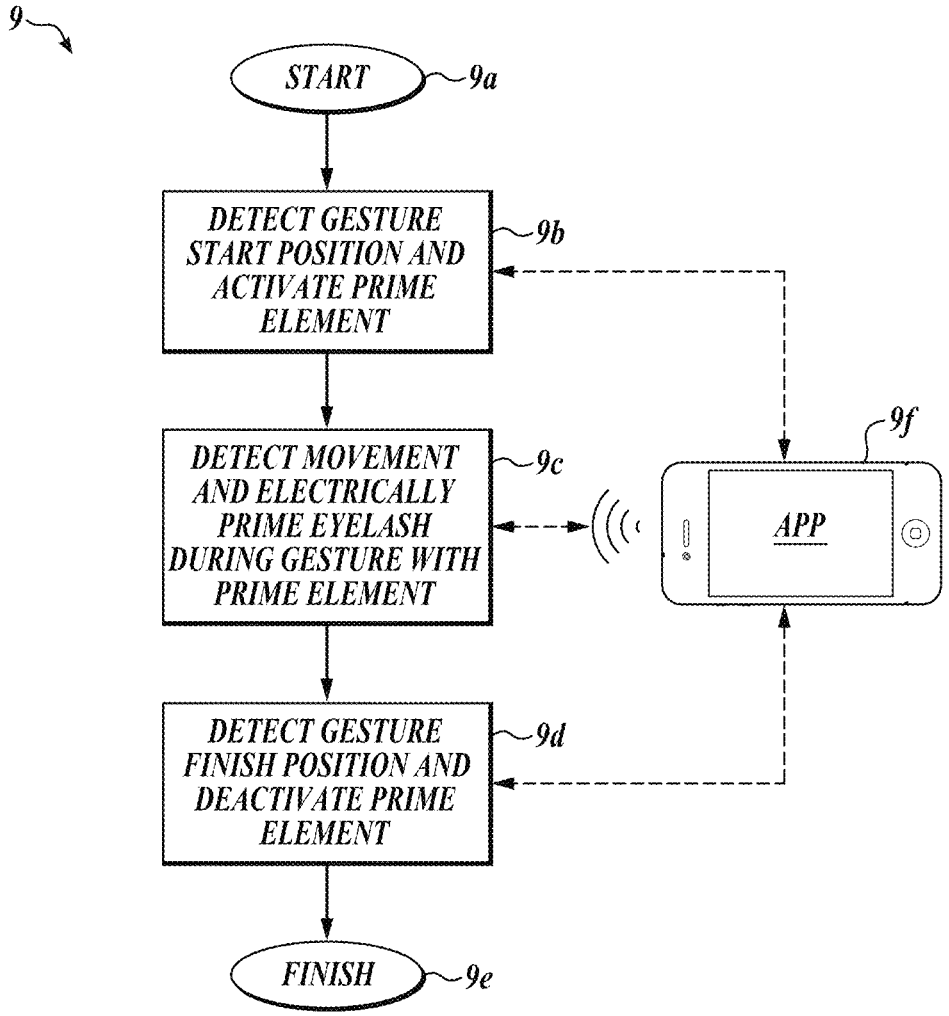
FIG. 7 shows a flowchart of an example method of operation of a device for priming eyelashes, according to aspects of the disclosure.

In embodiments, the device can perform various operations in support of the priming of the eyelashes. As shown by way of example at FIG. 7, an example method 9 of operation of a device for priming eyelashes can include, at step 9*a*, start; at step 9*b*, detect gesture start position and activate prime element (e.g., charge conductive bristles); at step 9*c*, detect movement and electrically prime eyelash during gesture with prime element; at step 9*d*, detect gesture finish position and deactivate prime element; and at step 9*e*, finish. In at least some embodiments, at least one of detection steps 9*b*, 9*c*, and 9*d* can be performed, at least in part, by computations performed by a computational device 9*f* operating device-compatible software ("APP"), for example.

In various aspects, the disclosure provides the concept of a working space, within which the device can be operable for priming the eyelashes and applying the composition to the eyelashes. The working space can include all or a portion of a length of an eyelash, and in embodiments, can include an extension length that extends beyond the natural terminus of an eyelash. The extension length can be quantified as a percentage of a natural length of the eyelash or simply as a unit of length. In embodiments, the extension length is a constant percentage or a variable percentage across a plurality of eyelashes within a set of eyelashes. In embodiments, the extension length is a constant length or a variable length across a plurality of eyelashes within a set of eyelashes.

The extension length can be user- or subject-selected, or can be customized for a particular application, for example, for use in art, film, studio, fashion, or makeup artistry to provide a particular or custom visual effect. The selection of a particular characteristic of the eyelash filament, such as the extension length, can be carried out at least in part as a result of selection of a virtual representation of the applied eyelash filament, generated by a computational device, prior to actual application of the eyelash filament thereto. For example, a camera of the device or a computational device can be used to capture an image of the eyelashes without the filament applied thereto, and the image used as the basis for generation of one or more virtual representations of one or more selectable eyelash filaments, shown as one or more overlays on one or more instances of the image. Selection of an overlay image with a particular extension length or other characteristic can serve as an input that signals to the device to be configured for application of the selected eyelash filament to the eyelashes during use.

Figure 10:
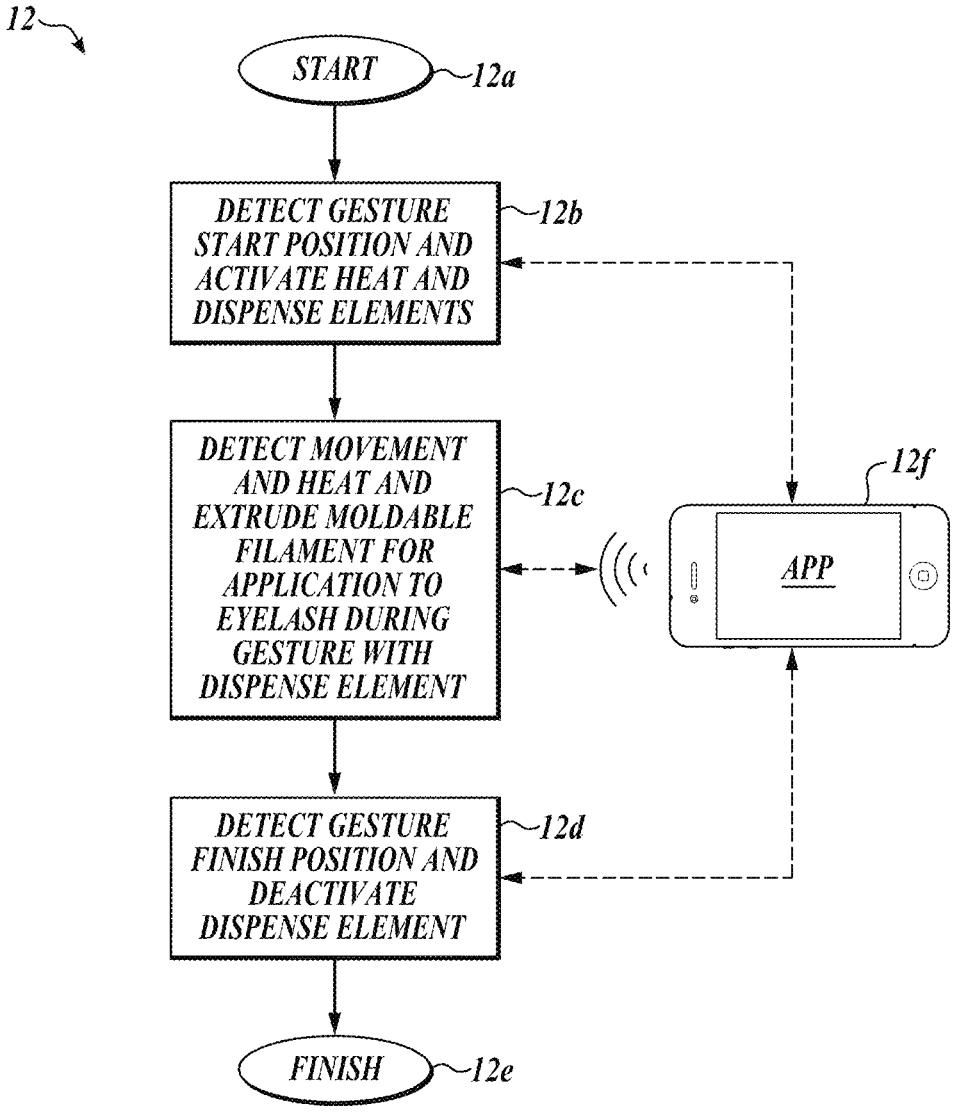
FIG. 10 shows a flowchart of an example method of operation of a device for applying moldable filament to eyelashes within a working space, according to aspects of the disclosure.

With regard to actual application of the composition, the device undergoes various operation steps in support of the process. FIG. 10 shows a flowchart of an example method 12 of operation of a device for applying moldable filament to eyelashes within a working space, according to aspects of the disclosure. The method 12 can include, at step 12*a*, start; at step 12*b*, detect gesture start position and activate heat and dispense elements; at step 12*c*, detect movement and heat and extrude moldable filament for application to eyelash during gesture with dispense element; at step 12*d*, detect gesture finish position and deactivate dispense element; and at step 12*e*, finish. In at least some embodiments, at least one of detection steps 12*b*, 12*c*, and 12*d* can be performed, at least in part, by computations performed by a computational device 12*f* operating device-compatible software ("APP"), for example.

Accordingly, in aspects, the disclosure provides a "smart" eyelash filament application device comprising circuitry configured to perform all or part of a method, including but not necessarily limited to control of heating of the composition, control of mixing of formulas for production of the composition, control of a pump of the device for extrusion of the composition within a working space based on sensor measurements, reporting of power source status including charge status, control of charging of priming bristles for use in priming the eyelashes, and the like.

In embodiments, circuitry of a device is configurable with a processor and processor-executable instructions stored on a non-transitory machine-readable medium of the device. In embodiments, a device includes a software application configured to perform all or part of one or more methods or processes of the disclosure, in any order or combination. However, in embodiments, a device includes dedicated hardware circuitry. Further configuration of circuitry of the device can include wireless communication or networking circuitry, for example, circuitry configured for a wireless connection, such as a Bluetooth® connection, a Bluetooth® low energy (BLE) connection, and/or a Wi-Fi® connection, and/or a wired connection. The networking circuitry, in combination with other circuitry of the computational device, can be used to request, retrieve, and/or receive data from a computational device or a remote server, for example.

In embodiments, the device can be managed, controlled, or operated with use of a computational device, such as a smartphone or personal computational device, that can be operated by a user via a graphical user interface, as known in the art. In embodiments, the circuitry can include operable connection of one or more sensors with the processor, or other circuitry, for performing logic operations and/or methods based on data received from the one or more sensors, for example, contact sensors, optical sensors, thermal sensors, and the like.

Tables

TABLE 1

Drawings references and descriptions.

| Reference | Description |
|---|---|
| 1 | Device |
| 1a | Handle |
| 1b | Head |
| 1c | Conductive bristle |
| 1d | Contact sensor pin |
| 1e | Bristle |
| 1f | Heat element and extruded outlet |
| 1g | Contact sensor circuitry |
| 1h | Conductance sensor circuitry |
| 1i | Accelerometer |
| 1j | Gyroscope |
| 1k | Thermal sensor |
| 1l | Processing unit |
| 1m | Printed circuit board (PCB) |
| 1n | Mixer |
| 1o | Motor |
| 1p | Pump |
| 1q | Formula mixture elements |
| 1r | Battery power source |
| 1s | Formula adapter 1 |
| 1t | Formula adapter 2 |
| 1u | Formula adapter 3 |
| 2 | Formula pack |
| 2a | Formula 1 |
| 2b | Formula 2 |
| 2c | Formula 3 |
| 2d | Formula pack adapter 1 |
| 2e | Formula pack adapter 2 |
| 2f | Formula pack adapter 3 |
| 3 | Device |
| 3a | Handle |
| 3b | Head |
| 3c | Conductive bristle |
| 3d | Contact sensor pin |
| 3e | Bristle |
| 3f | Heat element and extruded outlet |
| 3g | Contact sensor circuitry |
| 3h | Conductance sensor circuitry |
| 3i | Accelerometer |
| 3j | Gyroscope |
| 3k | Thermal sensor |
| 3l | Processing unit |
| 3m | Printed circuit board (PCB) |
| 3n | Mixer |
| 3o | Motor |
| 3p | Pump |

TABLE 1-continued

Drawings references and descriptions.

| Reference | Description |
|---|---|
| 3q | Formula mixture elements |
| 3r | Battery power source |
| 3s | Formula adapter 1 |
| 3t | Formula adapter 2 |
| 3u | Formula adapter 3 |
| 3v | Optical system |
| 3w | IR camera |
| 3x | Light |
| 4 | Device |
| 4m | PCB |
| 4y | Wireless transceiver |
| 5 | Computational device |
| 6 | Device |
| 6a | Handle |
| 6b | Head |
| 6c | Conductive bristle |
| 6d | Contact sensor pin |
| 6e | Bristle |
| 6f | Heat element and extruded outlet |
| 6g | Contact sensor circuitry |
| 6h | Conductance sensor circuitry |
| 6z | On/off control |
| 7 | Device |
| 7a | Handle |
| 7c | Conductive bristle |
| 7d | Contact sensor pin |
| 7e | Bristle |
| 7v | Optical system |
| 7z | On/off control |
| 8 | Method of use of device for priming eyelashes |
| 8a | Start |
| 8b | Activate eyelash device |
| 8c | Position eyelash device at gesture start position |
| 8d | Perform gesture to prime eyelash for receipt of moldable filament |
| 8e | Position eyelash device at gesture finish position |
| 8f | Finish |
| 9 | Method of operation of a device for priming eyelashes |
| 9a | Start |
| 9b | Detect gesture start position and activate prime element |
| 9c | Detect movement and electrically prime eyelash during gesture with prime element |
| 9d | Detect gesture finish position and deactivate prime element |
| 9e | Finish |
| 9f | Computational device |
| 10 | Method of use of a device for applying moldable filament to eyelashes |
| 10a | Start |
| 10b | Activate eyelash device |
| 10c | Position eyelash device at gesture start position |
| 10d | Perform gesture to apply moldable filament to eyelash |
| 10e | Position eyelash device at gesture finish position |
| 10f | Finish |
| 11 | Method of operation of a device for mixing, heating, and extruding moldable filament to eyelashes |
| 11a | Start |
| 11b | Activate heat, mix, and dispense elements |
| 11c | Mix plurality of compositions for moldable filament |
| 11d | Heat and extrude moldable filament for application to eyelash |
| 11f | Finish |
| 12 | Method of operation of a device for applying moldable filament to eyelashes within a working space |
| 12a | Start |
| 12b | Detect gesture start position and activate heat and dispense elements |
| 12c | Detect movement and heat and extrude moldable filament for application to eyelash during gesture with dispense element |
| 12d | Detect gesture finish position and deactivate dispense element |
| 12e | Finish |
| 12f | Computational device |

NON-LIMITING EMBODIMENTS

While general features of the disclosure are described and shown and particular features of the disclosure are set forth in the claims, the following non-limiting embodiments relate to features, and combinations of features, that are explicitly envisioned as being part of the disclosure. The following non-limiting Embodiments contain elements that are modular and can be combined with each other in any number, order, or combination to form a new non-limiting Embodiment, which can itself be further combined with other non-limiting Embodiments.

Embodiment 1. A device for application of a composition to a set of eyelashes, the device comprising: a dispensing system, comprising: a motor operably connected to a power source, a mixer operably connected to the motor and configured to mix a plurality of formulas to produce the composition, and a pump operably connected to the motor and configured to pump the composition through an internal volume of the device; and an application system, comprising: a heat element operably connected to the power source and configured to heat the composition within the internal volume, and an extruded outlet fluidly connected to the internal volume for extrusion of the composition therefrom.

Embodiment 2. The device of any other Embodiment, further comprising: a formula pack comprising the plurality of formulas, wherein the formula pack is reversibly attachable to a body of the device for delivery of the plurality of formulas to the mixer of the device to produce the composition.

Embodiment 3. The device of any other Embodiment, wherein the plurality of formulas comprises: a resin formula and a curing formula.

Embodiment 4. The device of any other Embodiment, wherein the plurality of formulas comprises: a customizable formula.

Embodiment 5. The device of any other Embodiment, further comprising: a thermal sensor configured to measure temperature of the composition within the internal volume of the device for a measured temperature, and circuitry operably connected to the thermal sensor and configured to control a function of the heat element for adjustment of temperature of the composition based on the measured temperature and a temperature threshold.

Embodiment 6. The device of any other Embodiment, wherein the temperature threshold is particular to the composition based on the plurality of formulas.

Embodiment 7. The device of any other Embodiment, further comprising: an accelerometer, a gyroscope, or both, operably connected to circuitry of the device for detection of a movement of the device, an orientation of the device, or both; wherein the movement, the orientation, or both is for determination of a status of a gesture to apply the composition to the set of eyelashes by the circuitry.

Embodiment 8. The device of any other Embodiment, wherein the status of the gesture is selected among a set of movement values, a set of orientation values, or both, positioned between a start point of the gesture and a finish point of the gesture, that define a working space within which extrusion of the composition from the device applies the composition to the set of eyelashes.

Embodiment 9. The device of any other Embodiment, further comprising: a contact sensor, a conductance sensor, or both, operably connected to circuitry of the device for detection of a position of the device relative to a facial feature; wherein the position is for determination, by the circuitry, of whether the device is positioned at a start point of a gesture to apply the composition to the set of eyelashes.

Embodiment 10. The device of any other Embodiment, wherein a set of position values, positioned between the start point of the gesture and a finish point of the gesture, define a working space within which extrusion of the composition from the device applies the composition to the set of eyelashes.

Embodiment 11. The device of any other Embodiment, further comprising: an optical system operably connected to circuitry of the device for detection of a position of the device relative to a facial feature; wherein the position is for determination, by the circuitry, of whether the device is positioned at a start point of a gesture to apply the composition to the set of eyelashes.

Embodiment 12. The device of any other Embodiment, wherein the optical system comprises: a light element configured to irradiate the facial feature and an infrared (IR) camera configured to capture an IR image of the facial feature and transmit data of the IR image to the circuitry of the device for determination, by the circuitry, of whether the device is positioned at the start point of the gesture to apply the composition to the set of eyelashes.

Embodiment 13. The device of any other Embodiment, further comprising: a wireless transceiver, operably connected to circuitry of the device, configured for wireless communication with a computational device comprising circuitry for user interaction with the device.

Embodiment 14. The device of any other Embodiment, further comprising: a plurality of bristles, arranged in a brush configuration or a clamp configuration, configured to contact the set of eyelashes for application of the composition thereto.

Embodiment 15. The device of any other Embodiment, further comprising: a plurality of conductive bristles operably connected to the power source and configured to hold an electric charge from the power source and contact the set of eyelashes to transfer at least part of the electric charge to the set of eyelashes, such that the set of eyelashes is primed to facilitate adherence of the composition thereto.

While illustrative embodiments have been illustrated and described, it will be appreciated that various changes can be made therein without departing from the spirit and scope of the invention.

The embodiments of the invention in which an exclusive property or privilege is claimed are defined as follows:

1. A device for application of a composition to a set of eyelashes, the device comprising:

a dispensing system, comprising: a motor operably connected to a power source, a mixer operably connected to the motor and configured to mix a plurality of formulas to produce the composition, and a pump operably connected to the motor and configured to pump the composition through an internal volume of the device; and an application system, comprising: a heat element operably connected to the power source and configured to heat the composition within the internal volume, and an extruded outlet fluidly connected to the internal volume for extrusion of the composition therefrom.

2. The device of claim 1, further comprising: a formula pack comprising the plurality of formulas, wherein the formula pack is reversibly attachable to a body of the device for delivery of the plurality of formulas to the mixer of the device to produce the composition.

3. The device of claim 1, wherein the plurality of formulas comprises: a resin formula and a curing formula.

4. The device of claim 1, wherein the plurality of formulas comprises: a customizable formula.

5. The device of claim 1, further comprising: a thermal sensor configured to measure temperature of the composition within the internal volume of the device for a measured temperature, and circuitry operably connected to the thermal sensor and configured to control a function of the heat element for adjustment of temperature of the composition based on the measured temperature and a temperature threshold.

6. The device of claim 5, wherein the temperature threshold is particular to the composition based on the plurality of formulas.

7. The device of claim 1, further comprising: an accelerometer, a gyroscope, or both, operably connected to circuitry of the device for detection of a movement of the device, an orientation of the device, or both; wherein the movement, the orientation, or both is for determination of a status of a gesture to apply the composition to the set of eyelashes by the circuitry.

8. The device of claim 7, wherein the status of the gesture is selected among a set of movement values, a set of orientation values, or both, positioned between a start point of the gesture and a finish point of the gesture, that define a working space within which extrusion of the composition from the device applies the composition to the set of eyelashes.

9. The device of claim 1, further comprising: a contact sensor, a conductance sensor, or both, operably connected to circuitry of the device for detection of a position of the device relative to a facial feature; wherein the position is for determination, by the circuitry, of whether the device is positioned at a start point of a gesture to apply the composition to the set of eyelashes.

10. The device of claim 9, wherein a set of position values, positioned between the start point of the gesture and a finish point of the gesture, define a working space within which extrusion of the composition from the device applies the composition to the set of eyelashes.

11. The device of claim 1, further comprising: an optical system operably connected to circuitry of the device for detection of a position of the device relative to a facial feature; wherein the position is for determination, by the circuitry, of whether the device is positioned at a start point of a gesture to apply the composition to the set of eyelashes.

12. The device of claim 11, wherein the optical system comprises: a light element configured to irradiate the facial feature and an infrared (IR) camera configured to capture an IR image of the facial feature and transmit data of the IR image to the circuitry of the device for determination, by the circuitry, of whether the device is positioned at the start point of the gesture to apply the composition to the set of eyelashes.

13. The device of claim 1, further comprising: a wireless transceiver, operably connected to circuitry of the device, configured for wireless communication with a computational device comprising circuitry for user interaction with the device.

14. The device of claim 1, further comprising: a plurality of bristles, arranged in a brush configuration or a clamp configuration, configured to contact the set of eyelashes for application of the composition thereto.

15. The device of claim 1, further comprising: a plurality of conductive bristles operably connected to the power source and configured to hold an electric charge from the power source and contact the set of eyelashes to transfer at least part of the electric charge to the set of eyelashes, such that the set of eyelashes is primed to facilitate adherence of the composition thereto.

* * * * *